US008561859B2

(12) United States Patent
Wochele et al.

(10) Patent No.: US 8,561,859 B2
(45) Date of Patent: Oct. 22, 2013

(54) DISPENSING DEVICE

(75) Inventors: Matthias Wochele, Allensbach (DE); Reinhard Lehmann, Rielasingen (DE)

(73) Assignee: Aptar Radolfzell GmbH, Radolfzell (DE)

( * ) Notice: Subject to any disclaimer, the term of this patent is extended or adjusted under 35 U.S.C. 154(b) by 823 days.

(21) Appl. No.: 12/657,127

(22) Filed: Jan. 14, 2010

(65) Prior Publication Data

US 2010/0187261 A1 Jul. 29, 2010

(30) Foreign Application Priority Data

Jan. 23, 2009 (DE) ..... 10 2009 006 431

(51) Int. Cl.

| | |
|---|---|
| ***B65D 47/00*** | (2006.01) |
| ***B65D 37/00*** | (2006.01) |
| ***B65D 47/18*** | (2006.01) |
| ***B67D 3/00*** | (2006.01) |

(52) U.S. Cl.
USPC ..... 222/547; 222/207; 222/420

(58) Field of Classification Search
USPC ..... 222/190, 207, 564, 486
See application file for complete search history.

(56) References Cited

U.S. PATENT DOCUMENTS

| | | | | |
|---|---|---|---|---|
| 3,998,427 | A | 12/1976 | Bentley | |
| 4,598,865 | A * | 7/1986 | Hamaguchi et al. | 239/342 |
| 4,712,738 | A | 12/1987 | Gill | |
| 5,207,381 | A | 5/1993 | Gill | |
| 5,704,550 | A * | 1/1998 | Foster et al. | 239/333 |
| 5,813,576 | A * | 9/1998 | Iizuka et al. | 222/190 |
| 6,503,487 | B1 | 1/2003 | Ohba | |
| 2007/0113841 | A1 * | 5/2007 | Fuchs | 128/200.14 |
| 2007/0262090 | A1 * | 11/2007 | Ritsche | 222/189.09 |
| 2009/0013994 | A1 | 1/2009 | Jones et al. | |

FOREIGN PATENT DOCUMENTS

| | | | |
|---|---|---|---|
| DE | 100 24 611 | A1 | 3/2001 |
| DE | 10 2004 050 679 | A1 | 4/2006 |
| EP | 0 414 364 | A1 | 2/1991 |
| WO | WO 9721492 | | 6/1997 |

OTHER PUBLICATIONS

European Patent Office Search Report dated Feb. 24, 2010 (6 pages).
Examination Report of Germany Patent Office dated Aug. 13, 2009 (4 pages).

* cited by examiner

*Primary Examiner* — Paul R Durand
*Assistant Examiner* — Benjamin R Shaw
(74) *Attorney, Agent, or Firm* — Flynn, Thiel, Boutell & Tanis, P.C.

(57) ABSTRACT

A dispensing device for dispensing liquid media having a housing, an outlet opening for the medium, a medium reservoir for storage of the medium and a conveying device for transporting the medium from the medium reservoir to the outlet opening, wherein a flow brake is provided in a medium duct between the conveying device and the outlet opening. The flow brake has a first flow brake component which can be arranged and fixed relative to the housing or to a second flow brake component during assembly in several differing relative positions, wherein differing flow resistances of the flow brake are achieved depending on the selected relative positions.

20 Claims, 5 Drawing Sheets

DISPENSING DEVICE

FIELD OF THE INVENTION

The invention relates to a dispensing device for dispensing liquid media, comprising a housing, an outlet opening for the medium, a medium reservoir for storage of the medium and a conveying device for transporting the medium from the medium reservoir to the outlet opening, wherein a flow brake is provided in a medium duct between the conveying device and the outlet opening.

BACKGROUND OF THE INVENTION

Generic dispensing devices are known from the prior art. They are used in particular for dispensing drugs in liquid form. Such dispensing devices comprise all the components required for dispensing and are transportable thanks to their usually small and compact design.

Depending on their intended application, particular forms of dispensing are required in certain generic dispensing devices. For example, in a dispensing device for eye drops, it is required that the medium comes out of the outlet opening in droplet form and does not form into a jet. To obtain these or similarly adapted forms of dispensing, it is known from the prior art that flow brakes are provided. These flow brakes are narrow passage points or ducts through which the medium must flow on the way to the outlet opening, wherein depending on the cross-sectional area of the duct transverse to the flow direction and on the length of the duct in the flow direction a restriction effect of varying intensity is achieved.

However, it is frequently necessary to redesign the flow brakes for different applications and/or different media, in order to obtain the specifically required restriction effect. This recurrent design effort is regarded as a drawback.

SUMMARY OF THE INVENTION

The object underlying the invention is therefore to improve a generic dispensing device in such a way that there is a simple possibility of adapting the effect of the flow brake specifically to an application with the least possible design effort.

This problem is solved in accordance with the invention in that the flow brake has a first flow brake component which is arrangable and fixable relatively to the housing or to a second flow brake component during assembly in several differing relative positions, wherein differing flow resistances of the flow brake are achieved depending on the selected relative positions.

With such an embodiment of a dispensing device, the flow brake can be adapted to the specific application. In this way it is possible with high-viscosity media and/or with an intended low restriction effect to set a low flow resistance of the flow brake during assembly, while a high flow resistance is set in the case of a low-viscosity medium and/or when a strong restriction effect is required. The setting of the flow resistance, and hence the restriction effect achieved, is fixed once during assembly by the alignment and/or arrangement of the first flow brake component. This setting is at least substantially maintained in the assembled state of the dispensing device. A change in the setting by the user is not desired. For that reason, the first flow brake component is preferably arranged inside the housing such that a change in the relative position is not possible without dismantling the dispensing device.

The flow resistance, varying depending on the relative position of the first flow brake component to the housing or to the second flow brake component, is achieved in that this relative position influences the geometry of the flow path along which the medium is conveyed to the outlet opening. This can for example be achieved by varying lengths of narrow duct sections and/or varying diameters of passages.

A simple embodiment provides that the first flow brake component on the one hand and the second flow brake component or the housing on the other hand can be aligned and fixed translatively relatively to one another during assembly. However, a design in which the first flow brake component on the one hand and the second flow brake component or the housing on the other hand can be aligned in various rotary settings against one another and fixed in various rotary settings is regarded as particularly advantageous.

An embodiment of this type is particularly space-saving and easily designable. The rotation axis about which the first flow brake component is rotatable relative to the second flow brake component or to the housing corresponds preferably to the main extension axis of the dispensing device and is in particular preferably aligned coaxially with the outlet opening. This use of the main extension axis as the rotation axis for the first flow brake component has the advantage that an already provided and substantially rotation-symmetrical component can be used as the first flow brake component. In this way, the use is expedient for example in particular of a valve body component firmly clamped on one side in the assembled state of the dispensing device as the first flow brake component.

It is particularly advantageous when the second flow brake component is provided fixed to the housing and the first flow brake component is movable in the course of assembly relative to the second flow brake component fixed to the housing.

A design according to which one of the flow brake components is fixed to the housing means that the alignment of this flow brake component relative to the housing is determined by the design, for example by a one-piece or positive connection to the housing. This facilitates the assembly process, since an adapted alignment in addition to the already usual and defined alignment of the housing is only required with respect to the first flow brake component. It is therefore particularly easy to ensure a correct alignment during the mechanical manufacturing process.

It is particularly advantageous when the position of the first flow brake component relatively to the housing or relatively to the second flow brake component is retained non-positively in the assembled state. A non-positive design of this type is more error-tolerant with regard to assembly precision than a positive fixing. With a non-positive fixing, it is furthermore possible to achieve a stepless adaptation of the relative position of the first flow brake component, which permits a stepless adjustability of the flow resistance and hence of the restriction effect depending on the design of the flow brake.

Besides a non-positive fixing of the first flow brake component relative to the second flow brake component or relative to the housing, further variants are however also possible, for example a positive securing whereby a relative positioning of the flow brake components to one another is only possible in defined fixing positions.

In an embodiment of the invention, a duct section is formed by the two flow brake components, wherein the length of the duct section varies depending on the relative position of the two flow brake components.

This flow brake duct section formed by the two flow brake components preferably has a narrow cross-sectional area. At the narrowest point, the cross-section area is preferably at most 1 $mm^2$, in particular and preferably at most 0.1 $mm^2$. The cross-sectional surface can be substantially uniform over the full length of the duct section. It is however also possible to form a tapering or flaring duct so that the setting of the relative position of the flow brake components to one another defines not only the duct length, but also the narrowest duct cross-section.

In this further embodiment, the flow brake components are in the assembled state directly adjacent to one another at least partially. The duct section is limited jointly by the two flow brake components. By enlarging or reducing the area in which the components are in contact with one another, a longer or shorter duct section can be formed. Preferably the flow brake components can furthermore be also moved into a relative position from which a bypass possibility for the medium results. In this relative position of the flow brake components, the medium is routed past the flow brake components and therefore does not undergo any restriction effect due to the duct section.

In particular in the embodiment with two flow brake components defining a duct section, it is regarded as advantageous when the first flow brake component is alignable relative to the second flow brake component in various rotary settings and fixable in various rotary settings. This allows a comparatively long duct section to be provided with a low space requirement.

The two flow brake components are in this design preferably designed to jointly form a duct section running around the common rotation axis of the two parts. The duct section extends preferably equidistantly on a circular arc about the rotation axis. This enables, depending on the application, the duct section to span an angle between 0° and approaching 360°, so that a particularly flexible adaptation is possible.

In a further embodiment of the invention, one of the flow brake components has a groove, wherein this groove is closed at least partially by the other flow brake component. With a design of this type, the two flow brake components thus form a common duct section in that the stated groove, i.e. a duct with a cross-section open on the one side, is provided in the one flow brake component. The other flow brake component is intended to close this open side of the cross-section over the length of the duct section to be formed. With this design, the duct section formed is formed by that part of the groove of the one flow brake component that is closed by the other flow brake component. The groove can extend beyond this closed area, but since the medium flowing through the closed area can exit from the groove unhindered beyond the second flow brake component that closes the area, this area no longer forms part of the restricting duct section, and influences the flow resistance at most to a negligible extent.

Surface sections flush with one another are preferably provided on both sides of the groove on one flow brake component, so that only a flat closing surface is necessary on the other flow brake component for closing the flow brake component with the groove.

It is regarded as particularly advantageous when the groove is open in the direction of the outlet opening and is closed there by the flow brake component fitted from the direction of the outlet opening. Alternatively, the groove can also be open in the radial direction, preferably being open to the inside, wherein the flow brake component arranged on the inside closes it in some sections.

The ingress of the medium to the groove and the exit from the groove are preferably in the same direction. It is therefore an advantage for the design when the inlet opening empties into the groove in the direction of the dispensing direction and the medium can exit from the groove at the end thereof in the direction of the dispensing direction.

In a further embodiment of the invention, one of the flow brake components is made at least partially from an elastic material, preferably from a material with a modulus of elasticity of less than 100 $N/mm^2$. The design of one of the flow brake components using an elastic material has in particular two advantages: firstly it achieves a secure seal in the area of the duct section. In this way it is for example possible to make the second flow brake component from an elastic material which forms the mating surface for closing the groove, open at one side, in the first flow brake component. It is achieved here, even with a low contact pressure, that this elastic mating surface makes a reliable contact with the groove edges and thus prevents any unwelcome exit of the medium in the area of the flow brake. The second advantage from the use of an elastic material is that the fixing of the flow brake components too relative to one another can be achieved in a particularly simple manner. For this purpose, the elastic flow brake component can be pressed against the other flow brake component so that a reliable non-positive connection is obtained.

In a further embodiment of the invention, a passage is formed by the two flow brake components, wherein the two flow brake components determine a minimum cross-section of the passage depending on their relative position to one another. With this design, it is accordingly not primarily the length of a duct section that is influenced, but instead the free cross-section of a passage. With regard to the design and fixing of the flow brake components of this alternative design, the implementation of the features of the aforementioned embodiments, for example the non-positive or positive fixing of the flow brake components relative to one another, is also regarded as advantageous.

In another further embodiment of the invention, the flow brake has a plurality of passage openings, wherein a different one of these passage openings must be passed by the medium during conveying from the medium reservoir to the outlet opening depending on the position of the first flow brake component relatively to the housing or relatively to the second flow brake component.

With a design of this type, it is accordingly not the same passage which is adapted in respect of its properties by an adaptation of the length and/or diameter. Instead, several passage openings separate from one another are provided, wherein due to the position of the first flow brake component relative to the second flow brake component or to the housing it can be determined which of the passage openings must be passed by the medium on the way to the outlet opening during assembly. The passage openings can differ from one another in their cross-section and/or length. The passage openings do not need to be designed as penetrations closed by a surrounding wall, but can also be provided as recesses open on one side like a groove along their extension direction and closed on that open side by a mating component. This leads to simpler manufacturing processes.

In a first alternative of the design with a plurality of passage openings, the plurality of passage openings is arranged in the second flow brake component or stationarily to the housing, wherein different passage openings are closed or opened respectively depending on the position of the first flow brake component relative to the housing or to the second flow brake component. With this design, it is therefore not necessary during assembly to adapt the position of the passage openings. The flow resistance of the flow brake is instead determined by some of the passage ducts through the first flow brake component being closed, whereas at least one of the passage openings is not closed by the first flow brake component.

Alternatively, it is possible with another design having a plurality of passage openings to provide the plurality of passage openings in the first flow brake component, wherein depending on the position of the first flow brake component relative to the housing or to the second flow brake component different passage openings are arranged in the flow path of the medium to the outlet opening. With this design, it is accordingly not the passage openings through the first flow brake component that are closed; instead, depending on the relative position of the first flow brake component, another of the passage openings provided in the first flow brake component is arranged such that the medium must pass through the appropriate passage opening on the way to the outlet opening.

BRIEF DESCRIPTION OF THE DRAWINGS

Further aspects and advantages of the invention can be gathered not only from the claims but also from a following description of two preferred embodiments of the invention shown in the following figures. The drawings show in:

DETAILED DESCRIPTION OF THE DRAWINGS

Figure 1:
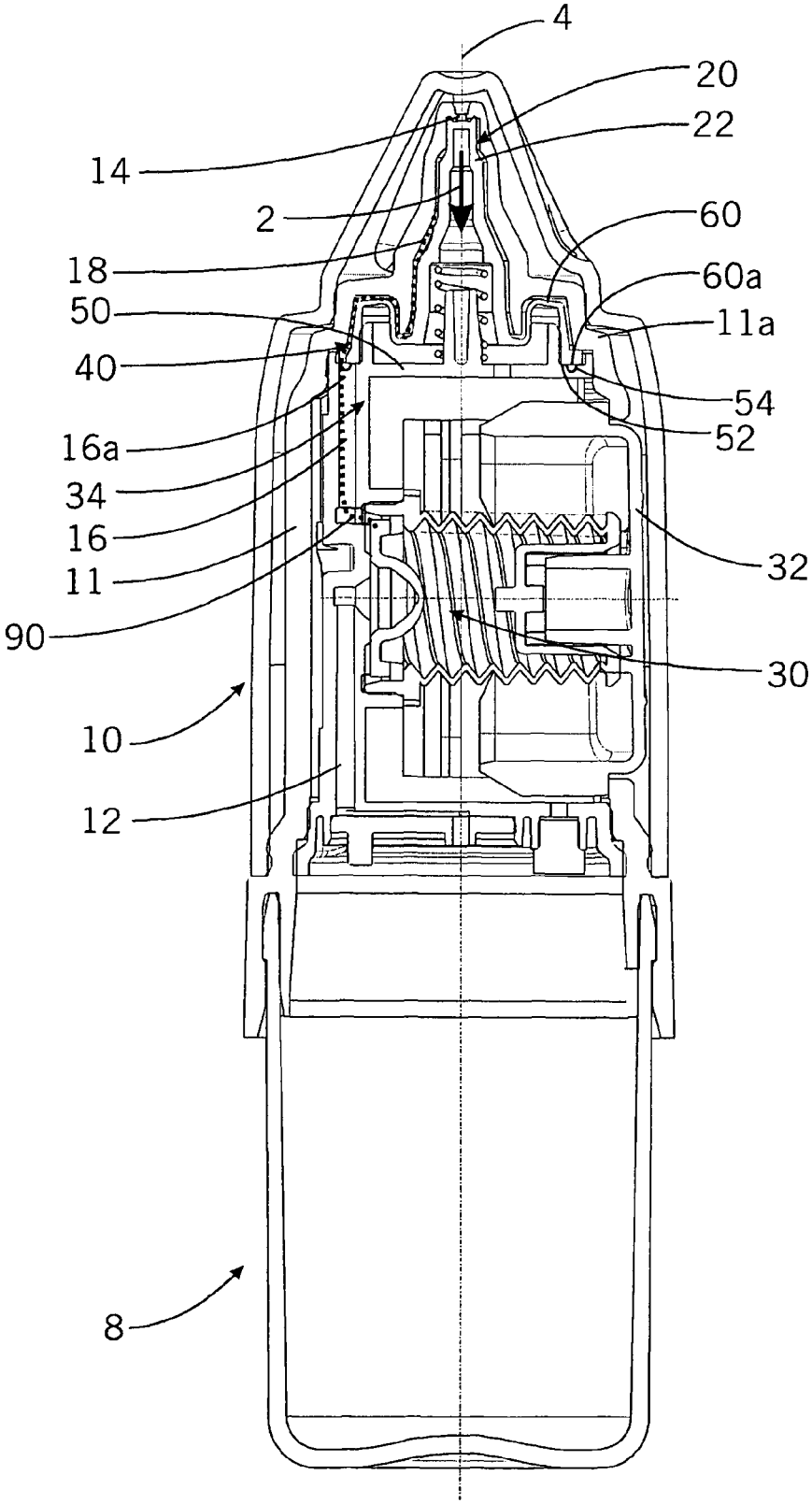
FIG. 1 a first embodiment of a dispensing device in accordance with the invention in a sectional side view, FIG. 2 the dispensing device of FIG. 1 with outer housing removed, FIGS. 3*a* to 3*d* different configurations of the flow brake of the dispensing device of FIGS. 1 and 2, FIG. 4 an alternative form of a settable flow brake, FIG. 5 different configurations of the flow brake according to FIG. 4 and FIG. 6 a further embodiment of a dispensing device in accordance with the invention with outer housing removed.

FIG. 1 shows a first embodiment of a dispensing device in accordance with the invention. This dispensing device has as its main component a conveying and dispensing unit 10 and a medium reservoir 8 connected thereto.

In the conveying and dispensing unit 10, which is closed off by an outside housing 11, a pump device 30 actuatable by an actuating push button 32 is provided with a pump chamber formed by a bellows and connected via an inlet duct 12 to the medium reservoir. This pump device 30 is intended to suck in medium from the medium reservoir 20 and convey it under pressure to an outlet opening 14. To do so, a connecting duct 16 extending from the pump device 30 is provided and connected via a flow brake unit 40 to a pressure chamber 18. The pressure chamber 18 is part of an outlet valve 20 of which the valve body 22 is moved in the direction of the arrow 2 when the pressure in the pressure chamber 18 is sufficiently high, so that the outlet opening 14 is opened.

Figure 2:
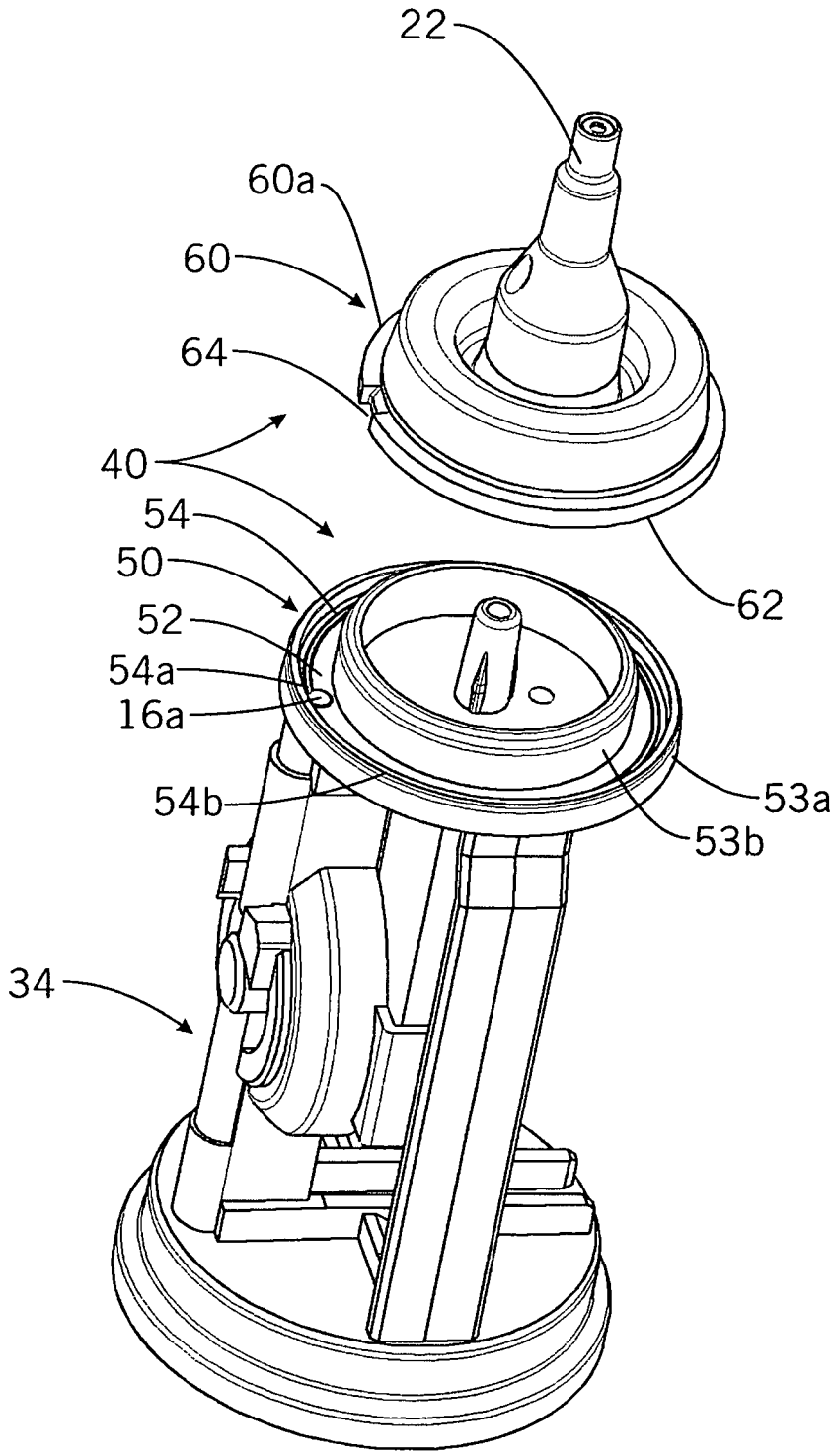

The particular feature substantial for the invention lies in the flow brake unit 40, which can be clearly discerned in particular in FIG. 2. This flow brake unit 40 has in particular a separate first flow brake component 60 and a second flow brake component 50 which represents the end face of an inner component 34 of the dispensing device. This second flow brake component 50 is aligned in a predetermined position inside the housing 11.

The second flow brake component 50 has an all-round annular surface 52 pointing in the direction of the outlet opening 14 and limited on the inside and outside by all-round webs 53*a*, 53*b* extending in the direction of the outlet opening 14. A groove 54 is provided in this annular surface 52 and shown enlarged for easier comprehension in FIG. 1. This groove 54 extends in a circle section form over a circle section of approx. 330° equidistantly to the main extension axis 4 of the dispensing device. A supply opening 16*a* is provided at one groove entrance 54 formed by the end of the duct 16. The groove 54 ends at its opposite end 54*b* at a distance of approximately 330° as stated from this entrance 54*a*.

The first flow brake component 60, which is shown in a lifted position in FIG. 2 for easier comprehension, is formed by an elastic component which has a valve body 20 at its end. The elasticity of this component is responsible for the pressure-dependent opening of the outlet valve 20. On the side 60*a* facing away from the valve body 20, the first flow brake component 60 has an annular cover surface 62 facing in the direction of the second flow brake component 50 and interrupted only in the area of an outlet zone 64 over an angular area of about 15°.

As can be seen from FIG. 1, this first flow brake component 60 is in the assembled state placed on the second flow brake component 50 such that the lower cover surface 62 of the first flow brake component 60 is in flush contact with the annular surface 52 of the second flow brake component 50. Here the flow brake components 50, 60 are pressed against one another by an all-round step 11*a* of the housing 11. As a result, the rotary setting of the first flow brake component 60 relative to the second flow brake component 50 is fixed non-positively relative to the main extension axis 4.

During assembly of the dispensing device, the length of a flow brake duct section can be adjusted by varying the rotary setting. This duct section is formed by that area of the groove 54 which is closed by the cover surface 62. Its length therefore depends on the position of the two flow brake components 50, 60 relative to one another. The restriction effect of the flow brake unit 40 changes depending on how long is the closed section of the groove 54 through which the medium must flow on the way from the pump device 30 to the pressure chamber 18.

Accordingly, a certain rotary setting of the first flow brake component 60 relative to the second flow brake component 50 is deliberately selected during assembly in order to obtain a resultant length of the duct section and thereby achieve a specific dispensing characteristic.

A first extreme state is reached when the components are put together in the alignment in FIG. 1, since in this case the supply opening 16*a* is aligned with the outlet zone 64. In this state, also shown schematically in FIG. 3*a*, the medium must therefore flow not into the groove 54 in order to reach the pressure chamber 18. Instead, the medium can flow along the path 90 shown as a dotted line in FIG. 1 directly into the pressure chamber 18. This state is accordingly the state with the lowest restriction effect.

FIGS. 3*a* to 3*d* show various settings of the dispensing device in a heavily schematic view from above. The second flow brake component 50 is here indicated by dashed lines. Only the edges of the annular surface 52, the supply opening 16*a* and the groove 54 of this second flow brake component 50 are shown here. The first flow brake component 60 is shown with unbroken lines. Only the lower cover surface 62 and the outlet zone 64 of the first flow brake component 60 are shown here.

Figure 3A:
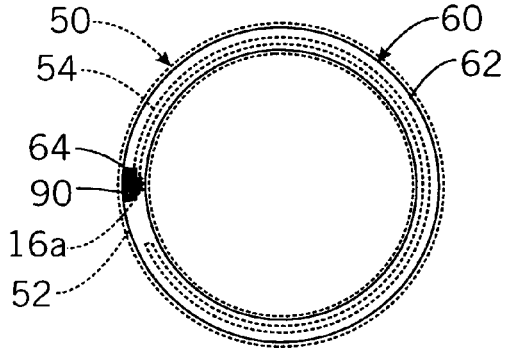

As already mentioned, FIG. 3*a* shows the same state as FIG. 1 does. In this first extreme state, the supply opening 16*a* and the outlet zone 64 are aligned so that the medium can flow directly past the flow brake unit 40 without the latter exerting any notable restriction effect. This path is shown in FIG. 3*a* by the black-coloured zone 90.

Figure 3B:
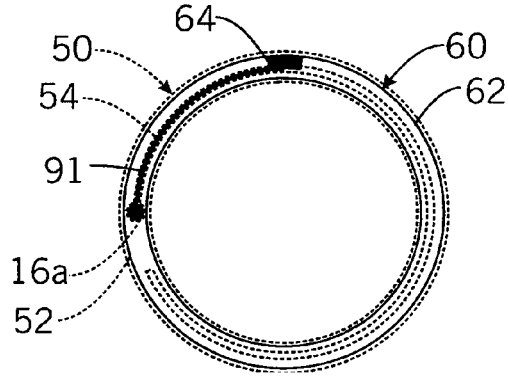

FIG. 3*b* shows a state in which the outlet zone 64 is at a distance of 90° from the supply opening 16*a*, so that the medium must flow along the black-coloured area 91 through a duct section formed by the groove 54 and the cover surface 62 before it can leave the flow brake unit 40 in the direction of the pressure chamber 18 at the outlet zone 64.

Figure 3C:
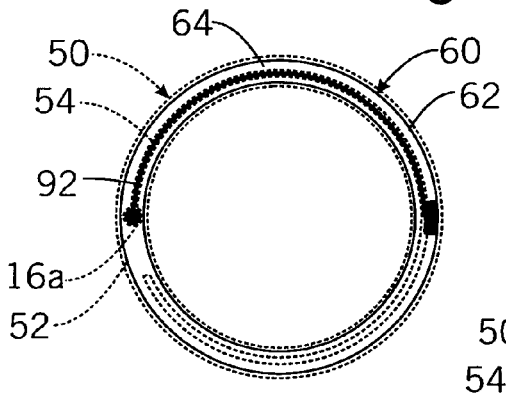

A further increase in the restriction effect is intended in the configuration shown in FIG. 3*c*. In this embodiment, the outlet zone 64 and the inlet opening 16*a* are at a distance of about 180° from one another, so that the comparatively long path 92 must be covered by the medium inside the duct section.

Figure 3D:
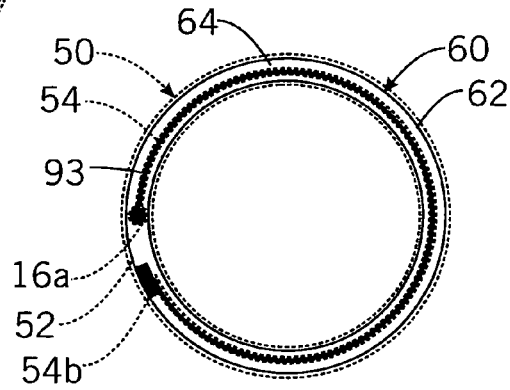

The maximum flow brake effect can be achieved with an alignment in accordance with FIG. 3*d*. With this alignment, the outlet zone 64 is arranged above the end 54*b* of the groove 54 so that the medium must flow over an angular area of about 330° along the path 93 through the groove 54 closed by the cover surface 62, in order to only then pass through the outlet zone 64 into the pressure chamber 18.

Figure 4:
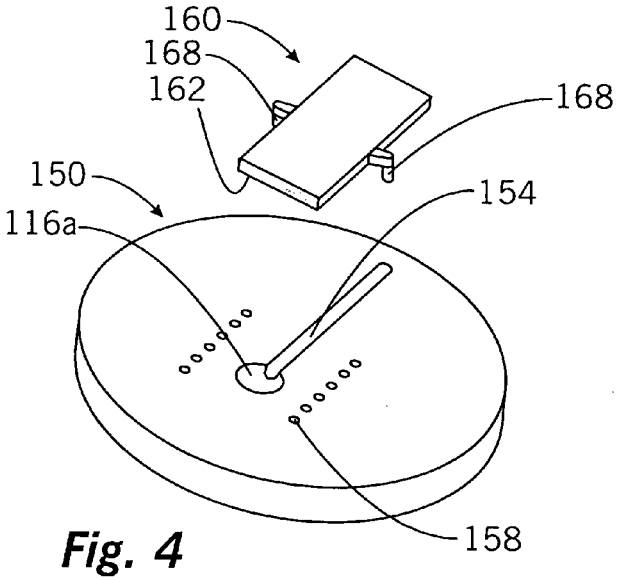

Even if the design with two flow brake components 50, 60 rotatable against each other about a rotation axis 4 is regarded as advantageous in many respects, it is also possible to design these two flow brake components translatively movable relative to one another. FIG. 4 shows schematically a design of this type. In this design too, a first and a second flow brake component 160, 150 are provided which are arranged inside the dispensing device in a manner not shown in detail.

The second flow brake component 150 is designed largely flat and has an extended groove 154 supplied with medium by an inflow duct 116*a* coming from underneath. Corresponding to the second flow brake component 150, the first flow brake component 160 is provided, on the underside of which a cover surface 162 is provided. This first flow brake component 160 has two holding pins 168 using which it can be inserted positively in variable positions into holding openings 158 of the second flow brake component 150.

Figure 5A:
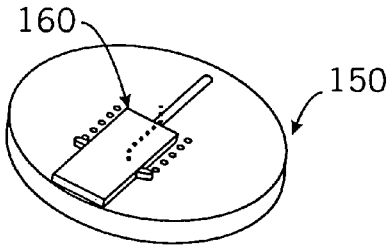
Figure 5B:
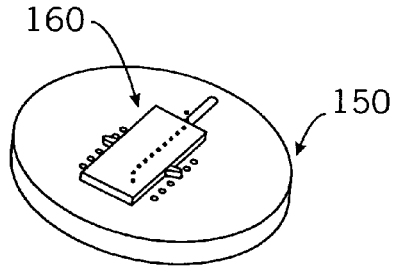
Figure 5C:
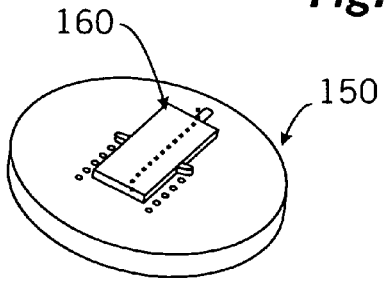

Depending on which relative position of the two flow brake components 150, 160 is selected, the medium must pass on its path from the supply opening 116*a* to its exit from the groove 154 sections of differing length in the groove 154 closed by the cover surface 162. FIGS. 5*a* to 5*c* illustrate these different relative positions. While the restriction effect of the flow brake is relatively low with the relative position of the flow brake components 150, 160 in FIG. 5*a*, it is already markedly higher with the relative position in FIG. 5*b*. The relative position of FIG. 5*c* has the maximum restriction effect.

Figure 6:
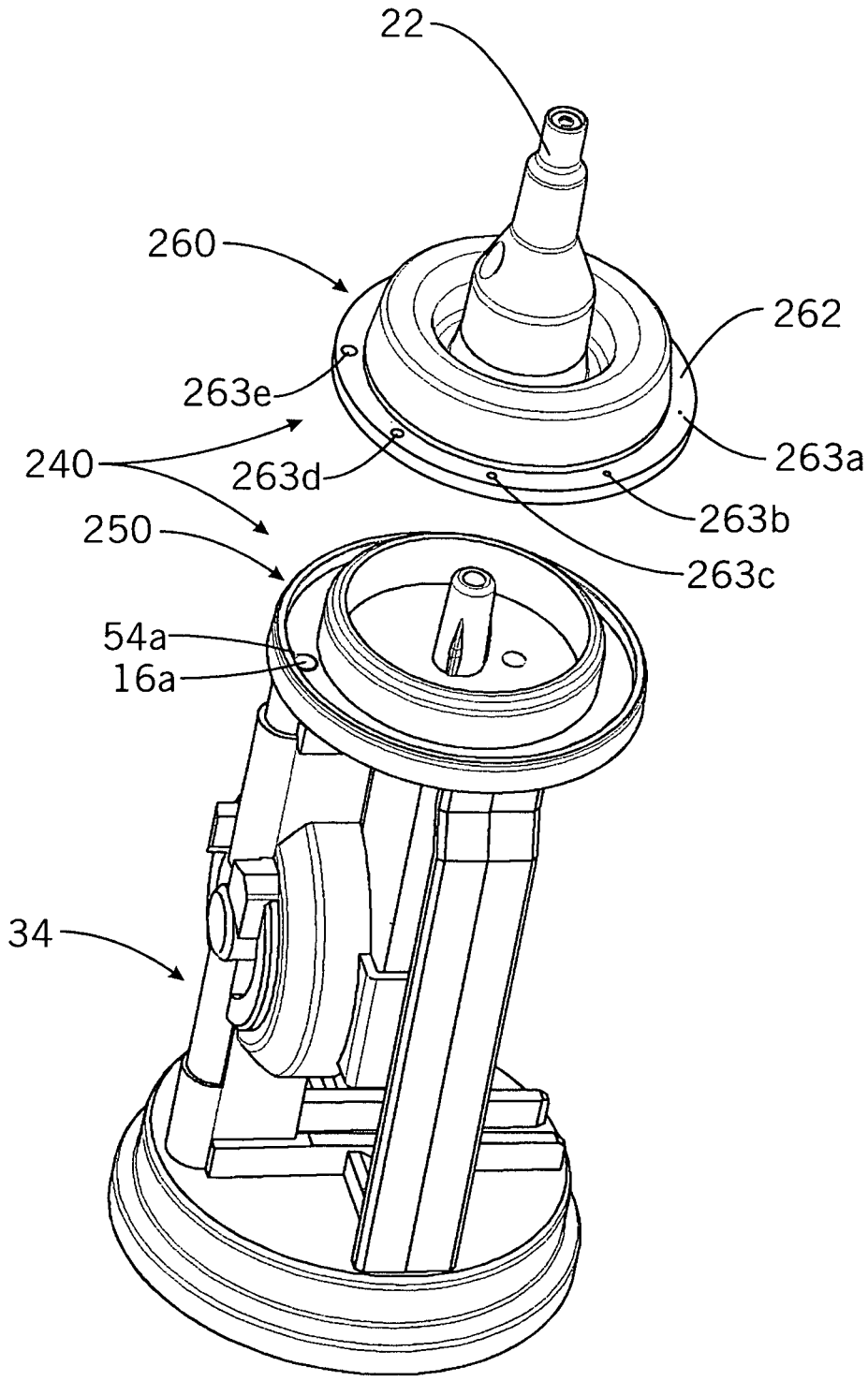

FIG. 6 shows a further embodiment of a dispensing device in accordance with the invention. This corresponds to the embodiment of FIGS. 1 to 3 in respect of most features. Unless otherwise described, the components correspond to those of the dispensing device of FIGS. 1 to 3. Substantially identical components are identified with the same reference numbers.

The illustration in FIG. 6, which corresponds substantially to that of FIG. 2, shows that in this embodiment no groove is provided on the second flow brake component 250, but only the supply opening 16*a*.

The main difference from the embodiment in FIGS. 1 to 3 lies however in the first flow brake component 260, which like the flow brake component 60 comprises an elastic material. This first flow brake component 260 has however a wider cover surface 262 in which five passage openings 263*a*-263*e* are provided spread over the circumference.

To achieve a specific restriction effect, the rotary setting of the first flow brake component 260 relative to the second flow brake component 250 is fixed during assembly such that a selected passage opening 263*a*-263*e* is arranged in alignment with the supply opening 16*a*. Since the medium must flow through this aligned passage opening 263*a*-263*e* in order to reach the outlet opening 14, the properties of the selected passage opening 263*a*-263*e* determine to a great extent the properties of the flow brake 240 of the dispensing device.

The invention claimed is:

1. A dispensing device for dispensing liquid medium comprising:

a housing;

an outlet opening for the medium in the housing;

a medium reservoir for storage of the medium, the medium reservoir being connected to the housing;

a conveying device for transporting the medium from the medium reservoir to the outlet opening; and a flow brake within the housing and in a media duct between the conveying device and the outlet opening;

wherein the flow brake has a first flow brake component which can be arranged and fixed relative to the housing or to a second flow brake component during assembly in several differing relative positions, wherein differing flow resistances of the flow brake are achieved depending on a selected one of the relative positions; and wherein the selected one of the relative positions cannot be altered without removing the housing from the medium reservoir.

2. The dispensing device according to claim 1, wherein the first flow brake component is alignable and fixable relative to the second flow brake component or the housing in various rotary settings.

3. The dispensing device according to claim 1, wherein the second flow brake component is fixed to the housing and the first flow brake component is movable during assembly relative to the second flow brake component fixed to the housing.

4. The dispensing device according to claim 1, wherein a relative position of the first flow brake component to the housing or to the second flow brake component is retained non-positively in an assembled state.

5. The dispensing device according to claim 1, wherein a duct section is formed by the first flow brake component and the second flow brake component, wherein a length of the duct section varies depending on awe relative position of the first flow brake component and the second flow brake component.

6. The dispensing device according to claim 1, wherein a first one of the flow brake components has a groove, and the groove is closed at least partially by a second one of the flow brake components.

7. The dispensing device according to claim 6, wherein the groove is, in relation to a main extension direction defined by a dispensing direction, open in the axial direction or open in the radial direction.

8. The dispensing device according to claim 1, wherein first one of the flow brake components is made at least partially from an elastic material.

9. The dispensing device according to claim 1, wherein a passage is formed by the first flow brake component and the second flow brake component, and the first flow brake component and the second flow brake component determine a minimum cross-section of the passage depending on a relative position of the first flow brake component to the second flow brake component.

10. The dispensing device according to claim 1, wherein the flow brake has a plurality of passage openings, and, depending on a relative position of the first flow brake component to the housing or to the second flow brake component, a different one of the passage openings must be passed by the medium during conveying from the medium reservoir to the outlet opening.

11. The dispensing device according to claim 10, wherein the plurality of passage openings are arranged in the second flow brake component or stationarily to the housing, and different passage openings are closed or opened respectively depending on the relative position of the first flow brake component to the housing or to the second flow brake component.

12. The dispensing device according to claim 10, wherein the plurality of passage openings are in the first flow brake component, and, wherein depending on a position of the first flow brake component relative to the housing or relative to the second flow brake component, different passage openings are arranged in a flow path of the medium to the outlet opening.

13. A dispensing device for dispensing liquid medium comprising:

a housing;

an outlet opening in the housing for allowing the medium to exit the housing;

a medium reservoir for storage of the medium, the medium reservoir being connected to the housing, the medium reservoir and the housing forming an interior area within the medium reservoir and the housing and an exterior area outside the medium reservoir and the housing when connected;

a conveying device within the housing for transporting the medium from the medium reservoir to the outlet opening; and a flow brake within the housing and interior area and located in a media duct between the conveying device and the outlet opening;

wherein the flow brake has a first flow brake component positionable relative to a second flow brake component during assembly in a selected one of several differing relative positions, with differing flow resistances of the flow brake being achieved depending on the selected one of the several differing relative positions; and wherein the first flow brake component cannot be moved relative to the second flow brake component from the exterior area by a user without removing the housing from the medium reservoir.

14. The dispensing device according to claim 13, wherein the second flow brake component includes an annular lower surface having a first opening therein and the first flow brake component includes a cover surface having a second opening therein, the annular lower surface and the cover surface define a duct therebetween, and the cover surface is positioned over the annular lower surface during assembly whereby the differing flow resistances are determined by a distance in the duct between the first opening in the annular lower surface and the second opening in the cover surface.

15. The dispensing device according to claim 14, wherein the second flow brake component includes an inner circular web defining an inner wall of the duct and an outer circular web defining an outer wall of the duct.

16. The dispensing device according to claim 15, wherein the cover surface is located between the inner circular web and the out circular web.

17. The dispensing device according to claim 13, wherein the second flow brake component includes a circular web defining an interior wall of the flow brake, with the circular web being received within the first flow brake component.

18. The dispensing device according to claim 13, wherein the second flow brake component is separate from the housing.

19. The dispensing device according to claim 13, wherein the second flow brake component is within the first flow brake component.

20. The dispensing device according to claim 13, wherein the second flow brake component comprises a plate having a groove ending in an inflow duct and a plurality of holding openings, the first flow brake component comprises a cover having a plurality of holding pins, and the first flow brake component is engaged with the second flow brake component at the selected one of the several differing relative positions by placing the holding pins into the holding openings.

* * * * *